United States Patent [19]

Kiesel et al.

[11] Patent Number: 4,714,222

[45] Date of Patent: Dec. 22, 1987

[54] BRACKET STRUCTURE FOR DENTAL PURPOSES

[75] Inventors: Helmut Kiesel; Klaus Stoeckl, both of Bensheim, Fed. Rep. of Germany

[73] Assignee: Siemens Aktiengesellschaft, Berlin and Munich, Fed. Rep. of Germany

[21] Appl. No.: 801,878

[22] Filed: Nov. 26, 1985

[30] Foreign Application Priority Data

Dec. 10, 1984 [DE] Fed. Rep. of Germany ..... 3445020

[51] Int. Cl.[4] ..... E04G 3/00

[52] U.S. Cl. ..... 248/282; 248/289.1; 248/558; 403/349

[58] Field of Search ..... 248/200, 282, 289.1, 248/324, 276, 278, 284, 558, 124, 160; 403/349, 348; 285/184, 181; 108/103, 139; 433/79

[56] References Cited

U.S. PATENT DOCUMENTS

| | | | |
|---|---|---|---|
| 719,662 | 2/1903 | Hawthorne | 248/200 |
| 3,010,013 | 11/1961 | Gunther et al. | 248/324 X |
| 3,742,209 | 6/1973 | Williams | 248/278 X |
| 3,774,773 | 11/1973 | Brent . | |
| 3,821,852 | 7/1974 | Kato | 433/79 X |
| 3,902,246 | 9/1975 | Wolf et al. . | |
| 4,037,861 | 7/1977 | Medney | 285/181 X |
| 4,209,192 | 6/1980 | Knight | 285/181 X |
| 4,305,560 | 12/1981 | Ban . | |
| 4,402,481 | 9/1983 | Sasaki | 248/276 |
| 4,532,672 | 8/1985 | Anderson | 403/349 X |
| 4,538,967 | 9/1985 | Furukawa | 403/349 X |
| 4,592,526 | 6/1986 | Kobelt | 248/278 |
| 4,615,191 | 10/1986 | Grandy | 403/349 X |
| 4,657,217 | 4/1987 | Kiesel et al. | 248/280.1 |

*Primary Examiner*—Ramon O. Ramirez

*Attorney, Agent, or Firm*—Hill, Van Santen, Steadman & Simpson

[57] ABSTRACT

The present invention is directed to a bracket structure which has one or more tubular members interconnected by elbow members. At least one of the tubular members is connected to an elbow member by a plug-type connection having a socket receiving a pin part with the socket and pin part being constructed so that no twisting will occur between the two parts in the assembled position but the two parts can be disassembled and reassembled with the position of the parts being rotated through at least 180° relative to each other. This provides the advantage of enabling easy changing of the bracket from being adapted for a floor mounting to a ceiling mounting.

17 Claims, 10 Drawing Figures

BRACKET STRUCTURE FOR DENTAL PURPOSES

BACKGROUND OF THE INVENTION

The present invention is directed to a bracket structure for a dental device, which structure has one or more straight pipe members interconnected by elbow members with at least one joint allowing rotation between the two connected members and connections between other members which do not allow any rotation or twisting between the other members.

A bracket structure for a dental instrument table, which has a first horizontal load-carrying member that is hinged to a vertical carrying pipe or pillar which is secured to a floor and a second horizontal load-carrying member which is connected to an instrument table and at its free end is in turn connected to rotate or move around a vertical axis relative to the first member, is disclosed in U.S. Pat. No. 3,902,246. Such a structure can only be utilized in the provided arrangement, i.e, with the bracket structure as disclosed being mounted on a pillar or post of a floor or base and cannot be easily mounted on the ceiling without substantial modifications. In addition, if the bracket structure is designed for fastening to the ceiling, it cannot be modified easily to be mounted to a floor without substantial changes. In addition, omission or shortening of the load-carrying members in the known structure is not possible or is only possible without an involved modification of the structure.

SUMMARY OF THE INVENTION

The present invention is directed to a bracket or load-carrying structure which has one or more straight load-carrying members or pipes and one or more pipe elbows which are connected together with a plug-in-type connection at least between some of the pipe members and elbow members which connections do not provide any rotation but can be unplugged and replugged relative to each other with at least 180° change in position. This type of bracket structure, which is explained in greater detail hereinafter, makes it possible to build an individual bracket structure or device with respect to the arc of movement for the various members and the links which are used by employment of respectively identical parts.

An exemplary embodiment of the invention is illustrated in the drawings and other advantages and objects of the invention are apparent from these drawings and the following description.

DESCRIPTION OF THE PREFERRED EMBODIMENTS

Figure 1:
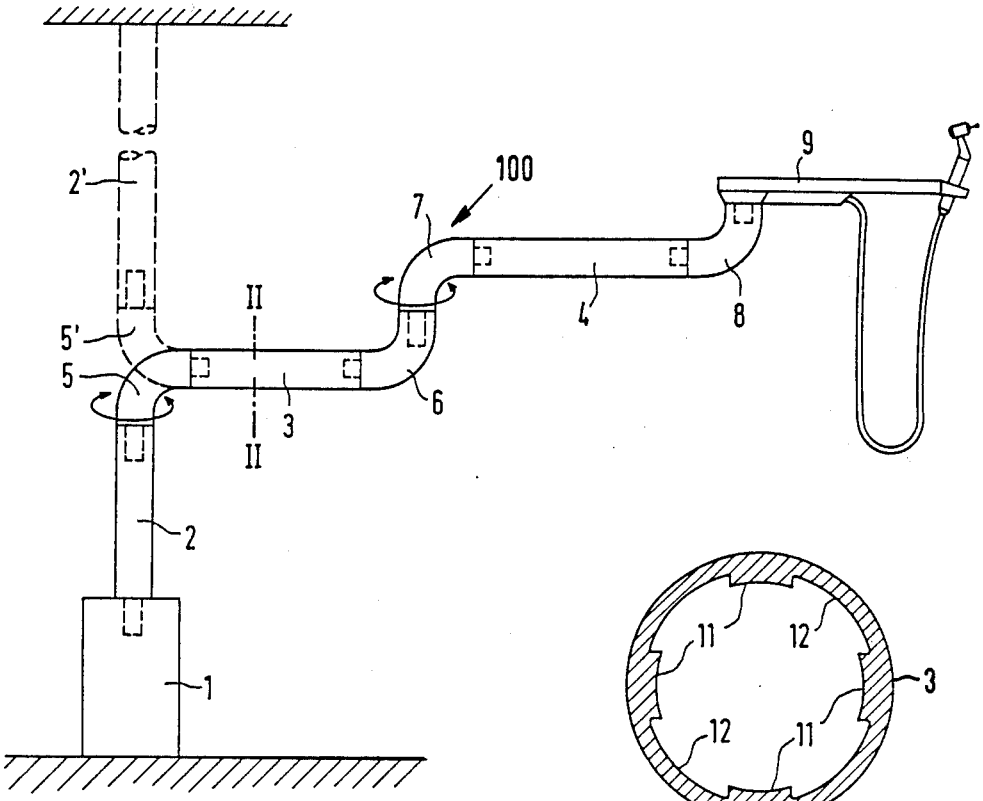
FIG. 1 is a side view of the bracket structure of the present invention mounted on a floor with a mounting to the ceiling shown in broken lines.

The principles of the present invention are particularly useful when incorporated in a bracket structure generally indicated at 100 in FIG. 1 which is illustrated for holding a dental instrument table 9 and is pivotable to enable moving the position of the instrument table 9 relative to a base or pillar 1. The bracket structure 100 is composed of a vertically extending tubular member or pipe 2, which is secured to the pillar or post 1 on the floor. It also includes two horizontally extending pipes, tubular members or arms 3 and 4 as well as a plurality of elbow members 5, 6, 7 and 8 which are used for interconnecting the tubular members 2, 3 and 4 as well as connecting the table 9 to the bracket structure 100.

As illustrated in bold lines, the bracket structure 100 is mounted on the pillar 1 and on the floor. The bracket structure can also be mounted to the ceiling as illustrated in broken lines by utilizing a vertical tubular member 2' and the pipe elbow member 5' which have been offset from the position of the elbow 5 and the tubular member 2 by 180°.

In both arrangements, the tubular members 3 and 4 can be pivoted relative to each other as indicated by the arrow. At all other connections, such as the connection between tubular member 4 and the elbow members 7 and 8, as well as the connection between the tubular member 3 and the elbow members 5 and 6, are rigid connections that are secured against any twisting or rotation between the members. In order to enable a certain height adjustment of the instrument table 9, either an additional height adjustment bracket can be provided or the tubular member 4 can be replaced by a parallelogram arm arrangement.

A significant feature of the bracket structure 100 is that tubular members 2, 3 and 4 have a constant profile which extends over the entire length which, as shall be explained in greater detail hereinbelow, mate with a correspondingly fashioned pin or pipe elbows 5–8 so that a torsion connection between the elbow member and the pipe member can be produced by means of an axial plug-in connection. The profile is fashioned so that the pipe elbow or member can be alternately offset relative to the pipe member by preferably 180° so that, as shown in FIG. 1 with broken lines, an elbow member 5 or 5' can be alternately mounted in the tubular member 3 with its one end upwardly directed or downwardly directed.

Figure 2:
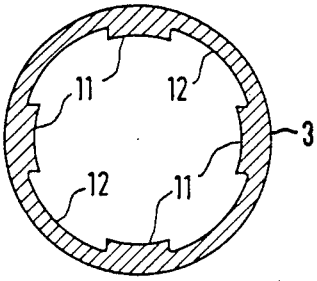
FIG. 2 is a cross-sectional view taken on lines II—II of FIG. 1.
Figure 4:
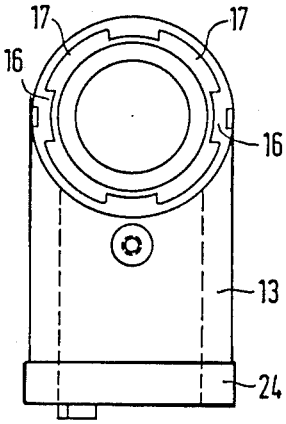
FIG. 4 is an end view of the elbow member of FIG. 3.

The profile of each of the tubular members is shown in FIG. 2. It is formed by a pipe such as the pipe 3 having a cylindrical outer generated surface and four inside ridges or elevations 11 uniformly distributed over the inner circumference and extending over the entire length of the pipe member with intervening depressions or channels 12. In other words, the base of the channels 12 would be the wall thickness of the pipe and the pipe has four distinct axially extending ridges or projections 11 which extend radially inwardly.

Figure 3:
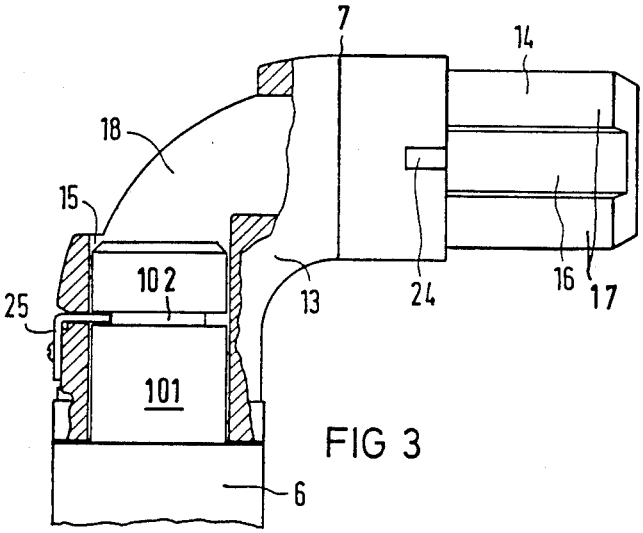
FIG. 3 is a partial cross-sectional view with portions in elevation of an elbow utilized in the bracket of FIG. 1 without the outer shell members or casing.

Each of the pipe elbow members 5 through 8 on one end has a cooperating projection or pin. As illustrated in FIG. 3, a pipe elbow member 7 has a hollow base portion 13 which at one end has a centering pin 14 and at the other end has a bore 15 for forming a socket to receive a pin 101 such as from an elbow member 6. The pin 101 has an annular groove 102 which receives a stop element such as an angle iron member 25 which is fastened on the base member 13. Thus, the pin 101 can rotate in the socket formed by the bore 15 but the angle iron member 25 prevents removal of the pin and thus disconnection between the elbows 7 and 6. The pin 14 mates with the profile of the tube 4 which is the same as the profile illustrated in FIG. 2. Thus, the pin 14 has four longitudinal channels or recesses 16, which are uniformly distributed on its circumference for receiving the elevations or projections 11 of the tubular member. The channels 16 are separated by radially extending ridges or projections 17 which are received in the channels 12 of the pipe member 3. Thus, the connection between the pin 14 and the pipe does not allow any rotation therebetween although by disassembly and rotating through 180° a downwardly extending connection such as attained between the pipe or tubular member 3 and the elbow 5 can be changed to an upwardly directed connection as illustrated by the connection between member 3 and the elbow member 5'.

Figure 6:
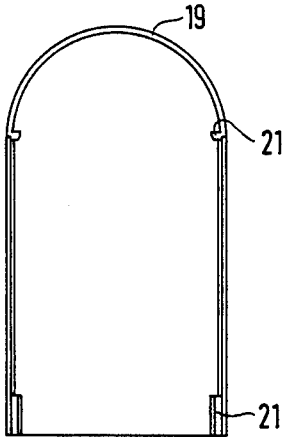
FIG. 6 is an end view of the upper cladding portion of FIG. 5.
Figure 5:
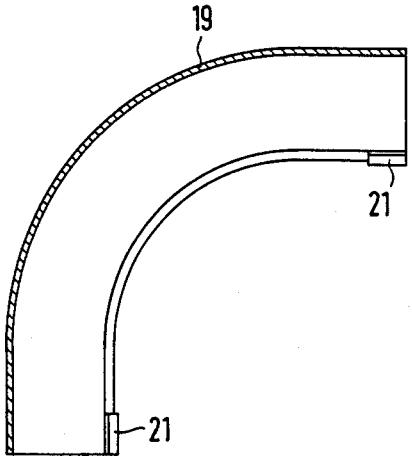
FIG. 5 is a cross-sectional view of an upper outer cladding portion for a pipe elbow of FIG. 3.
Figure 8:
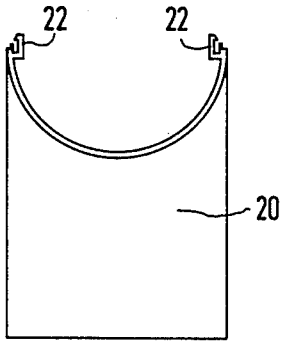
FIG. 8 is an end view of the lower cladding portion of FIG. 7.
Figure 7:
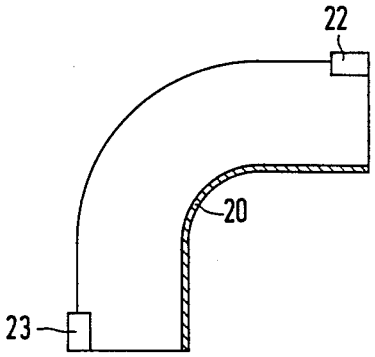
FIG. 7 is a cross-sectional view of a lower cladding portion for the elbow of FIG. 3.

In the region between the two ends, each of the base members 13 has a recess or opening 18 which creates access to the inside of the elbow so that, for example, lines laid on the inside can be more easily replaced. The generated outer surface of each of the base members 13 is unworked per se and is covered by two plastic half shells shown in FIGS. 5–8, which are an upper half shell of FIGS. 5 and 6 and a lower half shell 20 of FIGS. 6 and 7. The two half shells 19 and 20 contain suitable coupling elements such as 21 and 22 which mutually coact with each other to hold the half shells in place on the base member 13. Such coupling elements preferably fashioned as snap connector elements are known per se. The lower half shell 20 can be secured to the base member 13 by means of a suitable fastening means, for example, a snap element such as 23 which coacts with a snap element 24. In the attached condition, the half shell 19 covers a recess 18 of the base member 13. A significant advantage of this structure is that the surface of the base member 13 does not need to be finely worked since the two half shells 19 and 20 already exhibit the necessary surface quality. The half shells 19 and 20 can be injection-molded plastic parts which can be manufactured very inexpensively. In addition, by changing the parts 19 and 20, various colored designs can be attained to satisfy the desires of the customers and therefore the production of elbows with different colors is not necessary. As already mentioned, another advantage is that the lines which are laid in the overall bracket structure 100 can also be very easily subsequently supplied or inserted or even replaced because of easy access to the lines through the openings 18 in each of the pipe elbow members 5 through 8 after removal of the half shells such as 19 from each of the elbow members.

Figure 9:
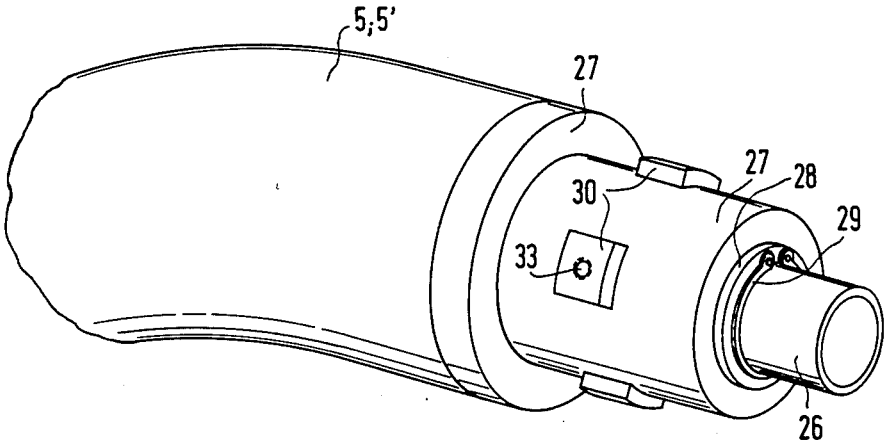
FIG. 9 is a perspective view of an end of an elbow member of the bracket in accordance with the present invention.
Figure 10:
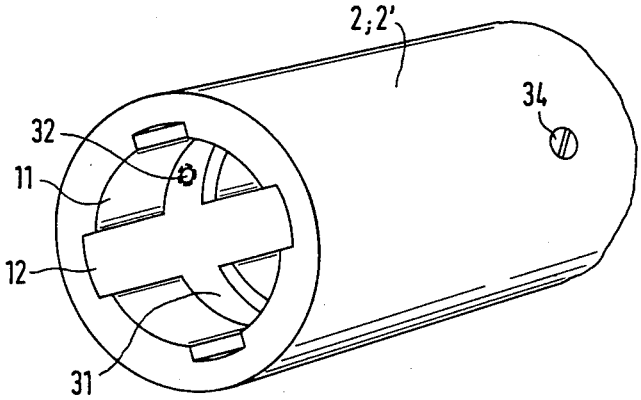
FIG. 10 is a perspective view of a mating socket for receiving the end of FIG. 9.

A connection of the pipe elbow members to the vertical carrying member 2 or, respectively, 2', is explained in greater detail with reference to FIGS. 9 and 10. This connection is a rotatable connection, i.e., the pipe elbow can be rotated through about 360° around the carrier pipe. Such a connection can also exist between the elbows such as 6 and 7 so that the arm 4 can be rotated relative to the arm 3 as desired.

A pin-shaped projecting pipe or hollow tube 26 is screwed into a bore 15 of FIG. 3 or is secured in some other fashion. A plastic bushing 27 is placed or slid onto the projecting pipe 26 and is axially secured by means of a washer 28 and a spring washer or clip 29. Together with the pipe 26 the plastic bushing 27 forms a bearing, i.e., the bushing is free to rotate relative to the pipe 26. As illustrated, the bushing 27 has a plurality of latch elements 30 which project from the circumferential surface of the bushing 27 with a spacing so that they will be received in the channels 12 of the tubes such as 2 or 2'. As shown in FIG. 10, the pipe contains a turned-out section or machined portion 31 whose depth dimensions correspond to that of the elements 30 so that when the part 2 and the elbow 5 are joined, a bayonet-like connection will occur after axial introduction of the parts via the depression 12 and after turning the two parts relative to each other. This bayonet-like connection absorbs the axial force given suspended assemblies. A set screw 32 can be provided in the carrying pipe 2 for securing the connection. The set screw 32 will be received in threads or into a blind bore such as 33 in the plastic bushing 27 and as illustrated, in a bore 33 provided in one of the projections 30 of the plastic bushing. With the set screw received in the threaded bore 33, a disconnection of the bayonet connection or joint is prevented.

In order to prevent an over-rotation of the two parts 2 and 5, detents limiting the rotational range to a maximum of approximately 360° can be provided. For example, the detents can be a pin or the like which is applied in the pipe member 2 at a location 34 and a corresponding location on the pipe 26.

As mentioned hereinabove, the connection between the two elbows 6 and 7 utilize the pin 101 which is received in the socket 15 and held from axial disengagement by a step which is formed by the angle member 25 being received in the groove 102. This connection or joint allows rotation but prevents axial movement until the stop 25 is removed.

Although various minor modifications may be suggested by those versed in the art, it should be understood that we wish to embody within the scope of the patent granted hereon, all such modifications as reasonably and properly come within the scope of out contribution to the art.

We claim:

1. In a bracket structure having one or more straight carrier members and elbow members, the improvement comprising at least one of the carrier members and at least one of the elbow members having mutual mating plug-in parts to form a rigid connection therebetween with coacting means including ridges and channels to prevent twisting between the parts and to enable a disassembly of the parts and reassembly with the positions offset relative to one another by at least 180°.

2. In a bracket structure according to claim 1, wherein the coacting means has each of the carrier members being a tubular member with an internal profile containing four longitudinally extending ridges evenly disposed on the inner circumference and separated by four channels and each of the plug parts received in the ends of the tubular members having four evenly distributed channels for receiving the ridges of the tubular member and four axially extending ridges being received in the channels of the tubular member.

3. In a bracket structure according to claim 2, wherein each of the tubular members has a continuous profile along its entire length with the four ridges and four channels.

4. In a bracket structure according to claim 1, wherein each of the elbow members is provided at one end with the plug part for insertion into the tubular member and at the other end with a bore for forming a socket to receive a pin member for forming a rotational connection.

5. In a bracket structure according to claim 4, wherein each of the elbow member is formed of a base member having an outer casing formed of two half shell members secured thereon.

6. In a bracket structure according to claim 5, wherein the base member contains an opening in the region of the elbow to enable access to the interior thereof.

7. In a bracket structure according to claim 5, wherein each of the half shells are connected to one another by snap elements.

8. In a bracket structure according to claim 1, wherein the coacting means has each of the carrier members having an interior profile consisting of evenly spaced ridges separated by channels, and the elbow members having a plug part with a matching profile comprising evenly spaced projections to coact with the channels in the one carrier member.

9. In a bracket structure according to claim 8, wherein said evenly spaced projections of one of the elbow members have a specific axial length and are spaced from the end of said plug part to form a bayonet coupling element and one tubular member is provided with a machined portion in the ridges to receive the projections of said one elbow member.

10. A bracket structure for supporting dental devices, said structure having at least one tubular member and at least one elbow member, said tubular member and elbow member having coacting plug-in parts comprising a socket part and a pin part received in said socket part, said socket part and pin part forming a connection having coacting means including projections and channels to prevent twisting therebetween when the parts are assembled and to enable disassembling and reassembling with the positions of the parts being offset relative to one another by at least 180°.

11. A bracket structure according to claim 10, wherein the projections for the pin part are at least two axially extending ribs separated by channels, the socket part has coacting channels for receiving the ribs of the pin part and the socket part has projections in the form of ridges for being received in the channels of the pin part.

12. A bracket structure according to claim 10, wherein each of the tubular members has an inner surface provided with four axially extending ribs along the length thereof, said ribs being separated by channels with the socket part being formed by the ribs and channels and the pin being part of the elbow member and having four axially extending radial projections separated by channels with the projections being received in the channels of the tubular member as the channels of the pin part receive the ribs of the tubular member.

13. A bracket structure according to claim 10, which has at least two tubular members connected together by an elbow member, wherein each tubular member has socket parts, each socket part has axially extending projections separated by channels, said projections on one socket part being cut away at a point spaced inwardly of the end of the socket part, one of the pin parts having a bushing with circumferentially spaced projections having an axial extent substantially equal to the cut-away portion of the projections of the one socket part, said bushing being mounted for rotation on the elbow part so that a bayonet-type connection can be formed between the one pin part and the one socket part and said elbow can turn relative to said bayonet-type connection.

14. A bracket structure according to claim 10, wherein each of the elbow members is formed of a hollow base member having an outer cladding formed of two half shells.

15. A bracket structure according to claim 14, wherein the base member has an opening to enable access to the interior of the elbow member when the half shells are removed from the base member.

16. A bracket structure according to claim 10, which has at least two elbow members and two tubular members, each elbow member having said pin part at one end for receiving the socket part of the tubular member, said elbow members having second means at the other end for forming a rotatable joint between the two elbow members so that each tubular member and its associate elbow member can turn relatively to the other tubular member and elbow member.

17. A bracket structure for supporting dental devices, said structure having at least two tubular members and one elbow member one of the tubular member and the one elbow member having coactive plug-in parts comprising a socket part and a pin part received in said socket part, said socket part and pin part forming a connection having coacting means including projections and channels to prevent twisting therebetween when the parts are assembled and to enable disassembly and reassembly with the position of the parts being offset relative to one another at at least 180°, the other of said two tubular members having a second socket part having axially-extending projections separated by channels, said projections of said second socket part being cut away at a point spaced inward of the end of the second socket part, said elbow member opposite the connection to the first tubular member having a pin part having a bushing with circumferentially spaced projections having an axial extent substantially equal to the cut-away portion of the projections of the one socket part, said bushing being mounted for rotation on said pin part so that a bayonet-type connection can be formed between the bushing and the second tubular member and said elbow can turn relative to the bayonet connection and said second tubular member.

* * * * *